United States Patent [19]

Pimlott et al.

[11] Patent Number: 4,670,123

[45] Date of Patent: Jun. 2, 1987

[54] STRUCTURAL FRAME FOR AN ELECTROCHEMICAL CELL

[75] Inventors: John R. Pimlott, Sweeny; Richard N. Beaver, Angleton; Hiep D. Dang; Gregory J. E. Morris, both of Lake Jackson, all of Tex.

[73] Assignee: The Dow Chemical Company, Midland, Mich.

[21] Appl. No.: 809,365

[22] Filed: Dec. 16, 1985

[51] Int. Cl.[4] ..... C25B 9/04; C25B 13/00

[52] U.S. Cl. ..... 204/279; 204/290 R; 204/290 F

[58] Field of Search ..... 204/256, 258, 265, 266, 204/277, 278, 279, 290 R, 290 F

[56] References Cited

U.S. PATENT DOCUMENTS

| | | | |
|---|---|---|---|
| 3,124,520 | 3/1964 | Juda | 204/86 |
| 3,632,498 | 1/1972 | Beer | 204/290 F |
| 3,849,279 | 11/1974 | Barkel | 204/256 X |
| 3,873,437 | 3/1975 | Pulver | 204/290 F X |
| 3,909,378 | 9/1975 | Walmsley | 204/98 |
| 4,025,405 | 5/1977 | Dotson et al. | 204/98 |
| 4,061,549 | 12/1977 | Hazelrigg, Jr. et al. | 204/98 |
| 4,065,366 | 12/1977 | Oda et al. | 204/98 |
| 4,116,888 | 9/1978 | Ukihashi et al. | 521/31 |
| 4,123,336 | 10/1978 | Seko et al. | 204/98 |
| 4,126,588 | 11/1978 | Ukihashi et al. | 521/31 |
| 4,142,005 | 2/1979 | Caldwell et al. | 427/126 |
| 4,151,052 | 4/1979 | Goto et al. | 204/95 |
| 4,176,215 | 11/1979 | Molnar et al. | 521/27 |
| 4,178,218 | 12/1979 | Seko | 204/98 |
| 4,187,350 | 2/1980 | McIntyre et al. | 429/45 |

(List continued on next page.)

FOREIGN PATENT DOCUMENTS

| | | |
|---|---|---|
| 0051432 | 5/1982 | European Pat. Off. . |
| 0051435 | 5/1982 | European Pat. Off. . |
| 0051437 | 5/1982 | European Pat. Off. . |
| 0051439 | 5/1982 | European Pat. Off. . |
| 0107612 | 5/1984 | European Pat. Off. . |

OTHER PUBLICATIONS

"An Electrochemically Regenerative Hydrogen-Chlorine Energy Storage System" *J. Electrochem. Soc.*, D. T. Chin, R. S. Yeo, J. McBreen and S. Srinivasan, pp. 713-730 (1979), vol. 126, No. 5.

*Primary Examiner*—Donald R. Valentine
*Attorney, Agent, or Firm*—James H. Dickerson, Jr.

[57] ABSTRACT

The invention is a structural frame adapted for use in an electrochemical cell comprising:

a plastic member with a plurality of horizontally and vertically spaced-apart shoulders protruding outwardly from opposing generally parallel first and second surfaces of said plastic member;

at least one electrically conductive insert extending from an exterior face of a shoulder on the first surface of the plastic member, through the plastic member, to an exterior face of a shoulder on the second surface of the plastic member, wherein each of said shoulders annularly encircles and supports each of said insert;

an electrically conductive, substantially completely hydraulically impermeable cover resistant to the corrosive effects of the electrolyte matingly contacting the first surface of said plastic member and with at least a portion of the inserts, said cover being adapted to minimize contact between the electrolyte and said plastic member;

a gas permeable current collector positioned substantially parallel to the second surface of the plastic member and contacting at least a portion of the inserts projecting outwardly from said second surface, thereby forming a compartment between the plastic member and the current collector;

a gas inlet passing through at least a portion of the peripheral frame of the plastic member into the compartment between the plastic member and the current collector; and a depolarized electrode positioned substantially parallel with and electrically connected to the current collector.

12 Claims, 2 Drawing Figures

U.S. PATENT DOCUMENTS

| | | | |
|---|---|---|---|
| 4,312,720 | 1/1982 | Lefevre | 204/78 |
| 4,317,704 | 3/1982 | McIntyre et al. | 204/1 R |
| 4,329,435 | 5/1982 | Kimoto et al. | 521/38 |
| 4,330,654 | 5/1982 | Ezzell et al. | 526/243 |
| 4,337,137 | 6/1982 | Ezzell | 204/252 |
| 4,337,211 | 6/1982 | Ezzell et al. | 260/456 F |
| 4,340,680 | 7/1982 | Asawa et al. | 521/27 |
| 4,341,606 | 7/1982 | McIntyre et al. | 204/98 |
| 4,357,218 | 11/1982 | Seko | 204/98 |
| 4,358,412 | 11/1982 | Ezzell et al. | 260/968 |
| 4,358,545 | 11/1982 | Ezzell et al. | 521/27 |
| 4,406,758 | 9/1983 | McIntyre et al. | 204/98 |
| 4,447,322 | 5/1984 | Zajdlik | 210/104 |
| 4,465,580 | 8/1984 | Kasuya | 204/290 R |
| 4,488,946 | 12/1984 | Morris et al. | 204/98 |
| 4,560,452 | 12/1985 | Morris et al. | 204/279 X |
| 4,192,725 | 3/1980 | Dotson et al. | 204/98 |
| 4,209,635 | 6/1980 | Munekata et al. | 560/183 |
| 4,212,713 | 7/1980 | Suhara et al. | 204/98 |
| 4,213,833 | 7/1980 | Lefevre | 204/98 |
| 4,214,971 | 7/1980 | Heikel et al. | 204/290 F |
| 4,224,129 | 9/1980 | McIntyre et al. | 204/263 |
| 4,251,333 | 2/1981 | Suhara et al. | 204/98 |
| 4,256,545 | 3/1981 | Deborski | 204/290 R |
| 4,260,469 | 4/1981 | McIntyre et al. | 204/265 |
| 4,269,691 | 5/1981 | Deborski | 204/290 R |
| 4,270,996 | 6/1981 | Suhara et al. | 204/98 |

STRUCTURAL FRAME FOR AN ELECTROCHEMICAL CELL

BACKGROUND OF THE INVENTION

This invention relates to an improvement in the structure of bipolar depolarized electrode-type, filter press-type electrolysis cells. More particularly it relates to those of such cells which employ permselective ion exchange membranes, or hydraulically permeable diaphragms planarly disposed between flat surfaced, parallel, porous, depolarized anodes and/or cathodes when said anodes and cathodes are mounted at a distance from the fluid impermeable structure of the bipolar electrode which physically separates adjacent electrolysis cells. Such cells are particularly useful in the electrolysis of aqueous solutions of alkali metal chlorides; especially in the electrolysis of aqueous solutions of sodium chloride (sodium chloride brine). The cell structure may also be used in electrolyzing other solutions to make products such as potassium hydroxide, iodine, bromine, bromic acid, persulfuric acid, chloric acid, adiponitrile and other organic compounds made by electrolysis.

It is well established that various chemicals can be produced in electrochemical cells containing an anode and a cathode. For example, alkali metal chlorates, such as sodium chlorate, have been formed electrolytically from a sodium chloride brine in cells without a separator positioned between the anode and the cathode.

When a separator, such as a hydraulically permeable asbestos or polytetrafluoroethylene diaphragm or a substantially liquid impervious ion exchange membrane, is used in a cell to electrolyze a sodium chloride brine, the electrolytic products will normally be gaseous chlorine, hydrogen gas, and an aqueous solution containing sodium hydroxide.

For a number of years gaseous chlorine was produced in electrolytic cells wherein an asbestos diaphragm was interposed between finger-like, anodes and cathodes which were interleaved together. During the past several years it has become apparent that the use of a substantially liquid impermeable cation exchange membrane may be preferable to the more well established diaphragm in instances where a higher purity, for example a lower sodium chloride content, higher sodium hydroxide product is desired. It was found to be more convenient to fabricate ion exchange type electrochemical cells from relatively flat or planar sheets of ion exchange membrane rather than to interleave the membrane between the anode and cathode within the older finger-like cells used with asbestos diaphragms.

The newer, so-called flat plate electrochemical cells using a planar piece of ion exchange membrane to separate the anolyte from catholyte compartments also have a plurality of solid, liquid impervious frames adapted to support the anode on one side and the cathode on the opposite side. These frames have previously been constructed of materials such as metal and plastic, but neither of these materials has been found to be entirely satisfactory. In any electrochemical cell, including both monopolar and bipolar cells, there is a possibility that electrolyte may leak from within the cell to the exterior. In instances where such leakage has occurred in cells with iron or other ferrous type frames, it was found that the iron frame corroded or was itself electrolytically attacked. Plastic frames are not generally subject to the electrolytic attack, but are normally not resistant to the anolyte and/or catholyte within the cell under operating conditions for extended periods of time, for example, several years.

It is desired to provide a structural frame for use in electrochemical cells which would minimize the corrosion problems and would increase the relatively short useful life attendant with those frames used by the prior art.

The cell of the present invention is particularly well suited for use with depolarized electrodes. Such electrodes may take the form of depolarized cathodes, where an oxygen-containing gas is contacted with one side of the cathode and an electrolyte is contacted with another side of the cathode. The cathode is a porous body which allows both the gas and the electrolyte to enter. Inside the cathode, with the addition of electrical energy from a power supply, electrochemical reactions are caused to occur. In the case of chlor-alkali cells, hydroxyl ions are produced without the production of hydrogen.

In the case of depolarized anodes, a hydrogen-containing gas is contacted with one side of an anode and an electrolyte is contacted with another side of the anode. The anode is porous and allows both the gas and the electrolyte to enter. Electrochemical reactions are caused to occur within the internal portions of the anode. In the case of chlor-alkali cells, hydrogen gas may be contacted with one side of the anode and a sodium chloride brine solution contacted with another side of the anode, to produce HCl.

Patents which teach various type of depolarized cathodes includes: U.S. Pat. Nos. 4,187,350; 4,213,833; 4,224,129; 4,256,545; 4,260,469; 4,269,691; 4,312,720; 4,317,704; 4,341,606; 4,406,758; 4,445,896; European Patent Application Nos. 0,051,432; 0,051,435; 0,051,437 and 0,051,439.

References which include depolarized anodes include: U.S. Pat. Nos. 3,124,520; 4,447,322; European Patent Application No. 107,612-A and "An Electrochemically Regenerative Hydrogen-Chlorine Energy Storage System", D. T. Chin, R. S. Yeo, J. McBreen, S. Srinivasan, Journal of Electrochemical Society, Volume 126, page 713, 1979.

SUMMARY OF THE INVENTION

The invention is a structural frame adapted for use in an electrochemical cell comprising:

an plastic member with a plurality of horizontally and vertically spaced-apart shoulders protruding outwardly from opposing generally parallel first and second surfaces of said plastic member;

at least one electrically conductive insert extending from an exterior face of a shoulder on the first surface of the plastic member, through the plastic member, to an exterior face of a shoulder on the second surface of the plastic member, wherein each of said shoulders annularly encircles and supports each of said insert;

an electrically conductive, substantially completely hydraulically impermeable cover resistant to the corrosive effects of the electrolyte matingly contacting the first surface of said plastic member and with at least a portion of the inserts, said cover being adapted to minimize contact between the electrolyte and said plastic member;

a gas permeable current collector positioned substantially parallel to the second surface of the plastic member and contacting at least a portion of the inserts projecting outwardly from said second surface, thereby forming a compartment between the plastic member and the current collector;

a gas inlet passing through at least a portion of the peripheral frame of the plastic member into the compartment between the plastic member and the current collector; and a depolarized electrode positioned substantially parallel with and electrically connected to the current collector; and

DESCRIPTION OF THE DRAWINGS

The invention can be better understood by reference to the drawing illustrating the preferred embodiment of the invention, and wherein like reference numerals refer to like parts in the different drawing figures, and wherein.

DESCRIPTION OF THE PREFERRED EMBODIMENTS

Figure 1:
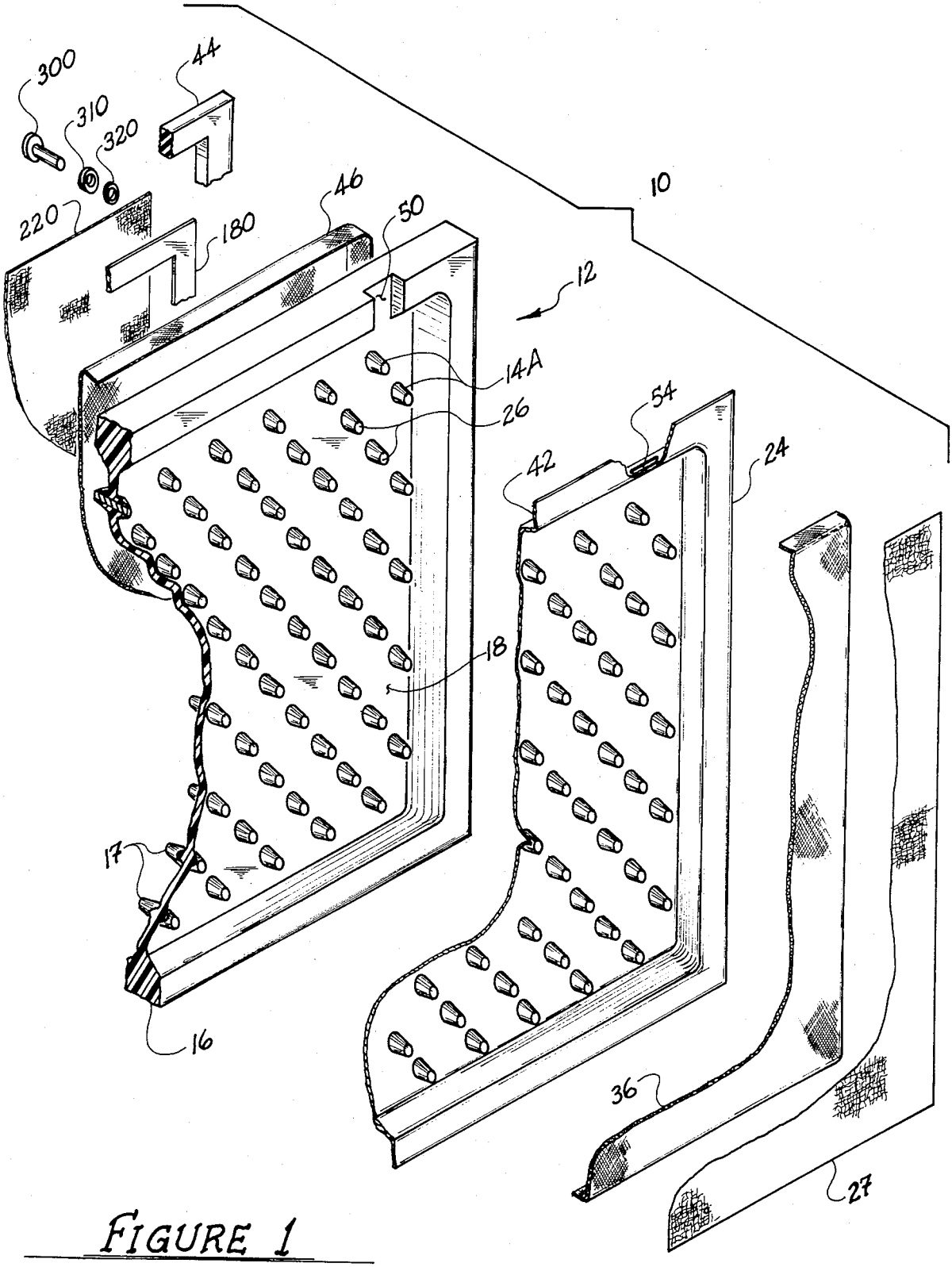
FIG. 1 is an exploded, partially broken-away perspective view of the unitary cell element 12 of this invention shown with accompanying parts forming one bipolar electrode type filter press-type cell unit 10 of a cell series of such cell units.

FIG. 1 shows the invention as it would be for use in an electrochemical cell for producing gaseous chlorine from an aqueous alkali metal hydroxide solution. The cell structure 10 includes a generally planar plastic member 12 which can be produced by commercial and known procedures into a shape with a plurality of horizontally and vertically spaced apart shoulders 14 and 14*a* surrounding and supporting at least one insert 26 which protrudes outwardly from the first and second surfaces of the plastic member 12. The configuration of the peripheral edges of the plastic member 12 is optional and can be varied to suit the particular configuration of the electrochemical cell shape desired, including rectangular, circular, etc.

A number of plastic materials are suitable for use in the present invention for the construction of the plastic member 12. Without intending to be limited by the specific organic materials hereinafter delineated, examples of such suitable materials include polyethylene; polypropylene; polyvinylchloride; chlorinated polyvinyl chloride; acrylonitrile, polystyrene, polysulfone, styrene acrylonitrile, butadiene and styrene copolymers; epoxy; vinyl esters; polyesters; and fluoroplastics and copolymers thereof. It is preferred that a material such as polypropylene be used for the structural member since it produces a shape with adequate structural integrity at elevated temperatures, is readily available, and is relatively inexpensive with respect to other suitable materials.

It is surprising that the plastic member 12 can be produced by any of a number of processes known well to those skilled in the art of plastic molding. Such molding processes include, for example, injection molding, compression molding, transfer molding, and casting. Of these processes, injection molding has been found to satisfactorily produce a structure with adequate strength for use in an electrochemical cell. Preferably, the plastic is injected into a mold containing the desired number of inserts 26 (discussed later). In this manner, the plastic member is a one-piece member which fits tightly around the inserts 26, holds them in place, and provides a high degree of support to them. Such a configuration minimizes the likelihood that the inserts 26 will separate from the plastic member and become loose. The ease of molding relatively complex shapes and the strength of the finished injection molded article contribute to making this process preferred for making the herein described structural member. This a considerable advantage over the prior art where the plastic member was molded first and then the electrical conductors were subsequently installed.

When the plastic member 12 is employed in an electrochemical cell for producing chlorine, the temperature of the cell and the plastic member will frequently reach, or be maintained at, temperatures of from about 60° to about 90° Celsius. At these temperatures plastics, as do most materials, expand a measurable amount. Any expansion and later contraction on cooling of the plastic member could result in electrolyte seeping from within the plurality of cells when joined together or, more importantly, could result in distortion of the anode and cathode which are made of metallic expanded mesh or perforated sheets. Furthermore, the differential expansion between the plastic member 12 and the cover 24 would create stress on the welds which affix this cover to the inserts 26 which are themselves molded in the plastic member 12.

To reduce, and preferably minimize, the difference in expansion between the cover 24 and the plastic member 12, it is preferred to incorporate an additive to reduce thermally induced expansion of the plastic member. More preferably, the additive will also increase the structural strength of the finished plastic article. Such additive can be, for example, fiberglass, graphite fibers, carbon fibers, talc, glass beads, pulverized mica, asbestos, and the like, and combinations thereof. It is preferred that the plastic contain from about 5 to about 75 weight percent and more preferably from about 10 to about 40 weight percent of the additive. Glass fibers can be readily mixed with polypropylene to produce an injectable material suitable for use in the present invention which results in a solid, physically strong body with a coefficient of expansion less than polypropylene not containing glass fibers. Of greater importance is the need to minimize the difference in expansion between the plastic member, the electrodes, and the current collector, since these elements are welded together and it is critical that they remain substantially flat and parallel.

It has been determined that the use of commercially available polypropylene which has been specially formulated to afford bonding with the glass works particularly well. This results in a composite having a lower coefficient expansion than a mixture of polypropylene and glass fibers. Such chemically-combined glass fiber reinforced polypropylene is available from, for example, Hercules, Inc., Wilmington, Del., as Pro-fax PC072 polypropylene.

At least one electric conducting element, such as insert(s) 26, is positioned and preferably molded into the plastic member 12. The insert(s) 26 extends through the plastic member from the second surface 13 to the first surface 18. The insert(s) 26 are preferably retained within the plastic member 12 by means of friction between the plastic and the insert(s). It is more preferable to increase the friction between these two bodies by having an additional means to restrain the insert(s) within the plastic. Such additional means include, for example grooves (one or more) around the circumference of the insert(s), keys welded to the insert(s), hole(s) extending into and/or through the insert(s), slots, rings, collars, studs, or bosses.

The insert(s) 26 can be any material which will permit flow of an electric current. Since the cover 24 is preferably metallic, it is convenient to fabricate the insert(s) from a metal, such as aluminum, copper, iron, steel, nickel, titanium, and the like, or alloys or physical combinations including such metals. To improve the flow of DC electric current through the insert(s) 26, it is preferable that the insert(s) 26 be made of a material weldably compatible with the particular cover it contacts.

Surrounding each of the inserts on each surface of the plastic member is a shoulder protruding outwardly from opposing generally coplanar first and second surfaces of the plastic member. Each of the shoulders annularly encircles and supports the electrically conductive insert(s). Each insert extends from an exterior face of a shoulder on the second surface 13 of the plastic member, through the plastic member, to an exterior face of a shoulder on the first surface of the plastic member. The shoulders and insert(s) are spaced sufficiently apart to allow a gas to freely circulate throughout at least a portion of the area between the plastic member and the electrode component.

The number, size, and shape of the shoulders 14 and **14*a* may be an important consideration in both the design and operation of the present invention. They may be square, rectangular, conical, cylindrical, or any other convenient shape when viewed in sections taken either parallel or perpendicular to the central portion. The shoulders 14 and 14*a* may have an elongated shape to form a series of spaced ribs distributed over the surface of the plastic member 12**.

The shoulders 14 and **14*a*** and insert(s) are preferably spaced so they provide a somewhat uniform and low electrical potential gradient across the face of the electrode to which they are attached. They are preferably spaced so that they allow free fluid circulation from any unoccupied point within their respective electrolyte compartment to any other unoccupied point within that compartment. Thus the shoulders will be somewhat uniformly spaced apart from one another in their respective compartments.

To prevent electrolyte from contacting the plastic member within the electrochemical cell and causing deterioration of the plastic and/or leakage of electrolyte between the plastic and the insert(s) 26, a cover 24 is matingly contacted with the first surface 18 of the plastic member 12. As is shown in FIG. 1, the cover is shaped to correspond closely to the exterior surface of the plastic member 12. The degree of correspondence may be more or less than illustrated in FIG. 1. In some instances, cover 24 may abut the plastic member 12 in one or more locations.

It is important that the portions of both of the cover 24 that is exposed to the electrolyte and spans the plastic member, contains no openings through which electrolyte or electrolytic products can pass. The freedom from openings through the cover minimizes the likelihood that electrolyte will come into contact with the plastic member.

When the cover 24 is an anolyte cover, it is preferably made from a material which is resistant to the anolyte in whatever cell it is being used in. Normally, this material is not electrolytically active, but the invention is still operable if the material does become, or is, electrolytically active. Suitable materials for use as a cover on the anolyte surface of a chlor-alkali electrolytic cell are, for example, titanium, tantalum, zirconium, tungsten, and other valve metals not materially affected by the anolyte. Titanium is preferred as the anolyte cover.

If the embodiment of the present invention employs a depolarized anode, optionally, the second surface 13 of the plastic member 12 may be covered with a catholyte cover (not shown). The catholyte cover is preferably resistant to attack by the catholyte under the conditions present in the electrochemical cell. Suitable materials for the catholyte cover for a chlor-alkali electrolytic cell include, for example, iron, steel, stainless steel, nickel, lead, molybdenum, and cobalt and alloys, including major portions of these metals. Nickel, including nickel base alloys, is preferably used for the catholyte cover in chlor-alkali cells because nickel and nickel alloys are generally resistant to the corrosive effects of the catholyte, especially an aqueous catholyte solution containing up to at least about 35 weight percent sodium hydroxide. Steel has also been found to be suitable, and relatively inexpensive, for use in a cell as a catholyte cover in the presence of a dilute (i.e., up to about 22 weight percent) aqueous solution of sodium hydroxide.

To assist in assembling a plurality of the structural frames 10 into an electrochemical cell it is desirable, although not essential, to have flange structure 16 extending outwardly from the main structural portion of the plastic member 12 along the periphery of such member. In a preferred embodiment the flange structure 16 extends outwardly from the plastic member 12 about the same distance as do insert(s) 26. Alternatively, but not preferred, separate spacer elements (not shown) could be utilized to build up the plastic member 12 sufficiently to permit a number of the plastic members to be combined into a cell series without having electrolyte, either anolyte or catholyte, leak from within the catholyte and anolyte compartments to an exterior portion of the cell.

FIG. 1 further shows an electrode 36, which is, for illustration purposes, positively charged during operation of the cell from an external power source (not shown). Such electrical connection is readily achieved by welding the electrode 36 to the cover 24 where the cover 24 comes into physical contact with at least a portion of the insert(s) 26. For improved electrical contact, the cover 24 may be welded to the insert(s) 26 and the electrode 36 may be welded to the cover 24 adjacent to the insert(s) 26.

Various means of welding can be utilized in the present invention, but it has been found highly satisfactory to use resistance or capacitance discharge welding techniques. Other suitable welding techniques include tungsten inert gas (TIG) and metal inert gas (MIG) welding. This welding serves a primary purpose of retaining the anode in position and not for electrical flow, although electric current will naturally pass through the welded areas.

For use in a chlor-alkali cell the electrode 36 is preferably metallic, and may be made from one of the common film-forming metals, which is resistant to the corrosive effects of the electrolyte during the operation of the cell. Suitable metals for use as covers in chlor-alkali cells include, for example, tantalum, tungsten, columbium, zirconium, molybdenum, and preferably, titanium and alloys containing major amounts of these metals, coated with an activating substance, for example, an oxide of a platinum group metals, such as ruthenium, iridium, rhodium, platinum, palladium, either alone or in combination with an oxide of a film-forming metal. Other suitable activating oxides include cobalt oxide either along or in combination with other metal oxides. Examples of such activating oxides are found in U.S. Pat. Nos. 3,632,498; 4,142,005; 4,061,549; and 4,214,971.

In those embodiments of the present invention in which a depolarized anode is used, the cathode may be a conventional cathode constructed of a material which is preferably resistant to the corrosive effects of the catholyte. Materials suitable for contact with the catholyte will depend upon the concentration of the alkali metal hydroxide in the aqueous solution and may be readily determined by one skilled in the art. Generally, however, materials such as iron, nickel, lead, molybdenum, cobalt, and alloys including major amounts of these metals, such as low carbon stainless steel, are suitable for use as the cathode. The cathode may optionally be coated with an activating substance to improve performance of the cell. For example, a nickel substrate could be coated with oxides of nickel and a platinum group metal, such as, ruthenium, or nickel and a platinum group metal, or oxide thereof such as ruthenium oxide, to reduce hydrogen overvoltage. U.S. Pat. No. 4,465,580 describes the use of such cathodes.

On the second surface 13 of the plastic member 12, there is gas picture frame 190 positioned between the membrane 27 and the depolarized electrode 220. A current collector 46 is positioned between the inserts 26 of the plastic member 12 and the depolarized electrode 220. The current collector is preferably welded to the insert(s) 26 to provide for good electrical transfer from the insert(s) 26 to the depolarized electrode 220. The current collector is an element which supports the electrode and and distributes electrical current to the electrode. The current collector can take the form of wire mesh, mattresses, perforated plates, and other materials well known in the art of depolarized electrodes. The depolarized electrode 220 is fastened to the current collector 46 using, for example, a silver plated stainless steel pop rivet 300 which passes through the depolarized electrode 220, through a conductive gasket 310; through a silver plated washer 320, and into a blind silver plated stainless steel eyelet 330 which is in a hole in the current collector 46. Electrical current flows from the front face of the depolarized electrode 220, through the pop rivet 300, through the washer 310 and the eyelet 330, through the current collector 46, through the weld between current collector 46, and into insert(s) 26.

Figure 2:
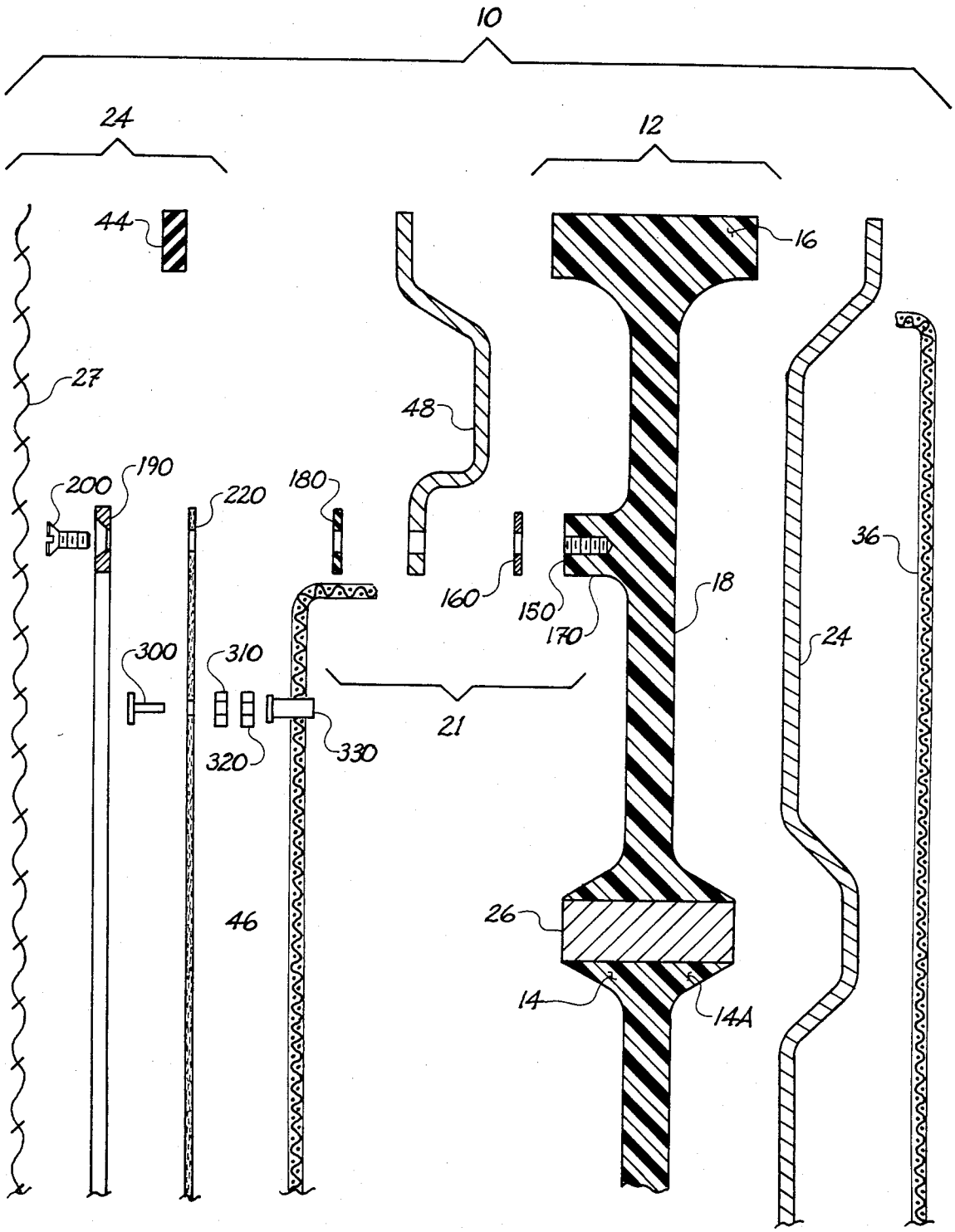
FIG. 2 is an exploded, sectional side view of the cell structure used in forming a bipolar electrode-type, filter press-type cell unit 10 which employs the unitary central cell element 12 of this invention, and which employs a depolarized electrode 220.

The membrane is positioned between each anode and each cathode, when a plurality of the units of the present invention are assembled in operable combination. For purposes of illustration, however, the electrochemical cell of FIG. 1 shows an ion exchange membrane 27 in contact with the electrode 36 and FIG. 2 shows the membrane in contact with the depolarized electrode 220.

Cation exchange membranes are well known to contain fixed anionic groups that permit intrusion and exchange of cations, and exclude ions, from an external source. Generally the membrane has a matrix of a cross-linked polymer, to which are attached charged radicals such as $—SO_3(-1)$, $—COO(-1)$, $—PO_3(-2)$, $HPO_2(-1)$, $—AsO_3(-2)$, and $SeO_3(-1)$. Vinyl addition polymers and condensation polymers may be employed. The polymer can be, for example, styrene, divinyl benzene, polyethylene and fluorocarbons. Condensation: polymers are, for example, phenol sulfuric acid, and formaldehyde resins. Representative of the types of permselective membranes envisioned for use with this invention are those disclosed in the following U.S. Pat. Nos. 3,909,378; 4,025,405; 4,065,366; 4,116,888; 4,123,336; 4,126,588; 4,151,052; 4,176,215; 4,178,218; 4,192,725; 4,209,635; 4,212,713; 4,251,333; 4,270,996; 4,329,435; 4,330,654; 4,337,137; 4,337,211; 4,340,680; 4,357,218; 4,358,412; and 4,358,545. These patents are hereby incorporated by reference for the purpose of the membranes they disclose.

To minimize leakage of electrolyte from the cell after assembling a number of the structural frames 10 together, at least one gasket 44 may be positioned between adjoining frames. During assembly of the frames a compressive force is applied to the extremes of the frames to compress the gasket material 44 so that it both seals the ion exchange membrane 27 in position and minimizes leakage of electrolyte from within the final cell series to the exterior of the cells. Preferably, the membrane 27 is positioned in a location to substantially entirely prevent leakage of electrolyte from within the final cell series to the exterior of the cells. Various gaskets materials (depending upon the type of cell in which the present invention is used) can be used including, for example, for chlor-alkali applications, fluorocarbon, chlorinated polyethylene rubber, and ethylene propylene diene terpolymer rubber.

A recess 50, as shown in FIG. 1, is provided in the plastic member 12 to permit an opening through which materials may enter the cell or be removed from the cell. Preferably, a pipe, tube, or shaped metal conduit is positioned within the recess 50 and affixed to the cover 24 to facilitate substantially leak free removal of the product from the cell. Similar conduits or recesses may be provided on the second surface 13 of the plastic member 12 to permit feeding, for example, water into the cathode compartment and removal of products, such as a solution containing sodium hydroxide, and optionally hydrogen, therefrom.

A partial cover 48 may optionally be provided on the depolarized electrode surface 13 of the plastic member 12 to protect the plastic member 12 from the effects of any liquid that may be present in compartment 24. Partial cover 48, may thus, be in the shape of a picture frame which covers the portions of the plastic member 12 which are not part of the gas compartment.

When the cell unit 10 of the present invention is assembled in operable combination with other such similar units, two chambers are formed between the second surface 13 and the membrane 27: (1) a first compartment 21 (gas compartment) is formed between the depolarized electrode 220 and the planar plastic member 12; (2) and a second compartment 24 (liquid compartment) is formed between the ion exchange membrane 27 and the depolarized electrode 220.

The gas compartment 21 is sealed by gasket 160. The liquid compartment 24 is sealed from the gas compartment 21 by gasket 180. Screws 200 apply force through a picture frame 190 to the face of the depolarized electrode 220, to gasket 180, to cover 48, to gasket 160, and finally to the plastic member 12 at a shoulder 170. The shoulder 170 has an opening 150 adapted to receive the screw 200.

The gas compartment 21 is preferably operated at a higher pressure than that of the electrode compartment 24 (to force the gas through the pores). Similarly, electrode compartment 24 is preferably operated at a higher pressure than the electrode compartment 22 (to force the membrane 27 against the electrode 36 so the liquid in liquid compartment 24 can flow over face of the depolarized electrode 220).

In operation of the cell, a gas is introduced into the gas compartment 21 and electrolyte is circulated through the the liquid compartment 24. The electrolyte flows into the porous areas of the depolarized electrode 220 from the gas compartment 24. The gas flows from the gas compartment 21 into the porous areas of the depolarized electrode 220. Inside the depolarized electrode 220, electrochemical reactions are caused to occur between the electrolyte and the gas.

In the embodiment where the present invention is used with depolarized cathodes in a chlor-alkali cell, an oxygen-containing gas is introduced into the gas compartment 21. Electrochemical reactions are caused to occur between the oxygen-containing gas and the electrolyte to form hydroxyl ions. The hydroxyl ions mix with the sodium ions in the aqueous NaCl electrolyte to form sodium hydroxide. The sodium hydroxide is removed from the liquid compartment through outlets (not shown). Continuously during the occurrence of such reactions, additional electrolyte flows through the ion exchange membrane 27 into the liquid compartment 24. In addition, water may optionally be added to the liquid compartment 24. As the oxygen in the oxygen-containing gas is consumed, additional oxygen-containing gas may be introduced into the gas compartment 21. Any liquids that weep through the porous electrode may be removed at an outlet port (not shown) from the gas compartment 21.

What is claimed:

1. A structural frame adapted for use in an electrochemical cell comprising:

a plastic member with a plurality of horizontally and vertically spaced-apart shoulders protruding outwardly from opposing generally parallel first and second surfaces of said plastic member;

at least one electrically conductive insert extending from an exterior face of a shoulder on the first surface of the plastic member, through the plastic member, to an exterior face of a shoulder on the second surface of the plastic member, wherein each of said shoulders annularly encircles and supports each of said insert;

an electrically conductive, substantially completely hydraulically impermeable cover resistant to the corrosive effects of electrolyte matingly contacting the first surface of said plastic member and at least a portion of the inserts, said cover being adapted to minimize contact between the electrolyte and said plastic member;

a gas permeable current collector positioned substantially parallel to the second surface of the plastic member and contacting at least a portion of the inserts projecting outwardly from said second surface, thereby forming a compartment between the plastic member and the current collector;

a gas inlet passing through at least a portion of the peripheral frame of the plastic member into the compartment between the plastic member and the current collector; and a depolarized electrode positioned substantially parallel with and electrically connected to the current collector.

2. The frame of claim 1 wherein the plastic is selected from the group consisting of polyethylene, polypropylene, polyvinylchloride, polystyrene, polysulfone, styrene acrylonitrile, chlorinated polyvinylchloride, acrylonitrile, butadiene and styrene copolymers, epoxy, vinyl esters, polyesters, and fluoroplastics.

3. The frame of claim 1 wherein the plastic contains an additive selected from the group consisting of fiberglass, graphite fibers, carbon fibers, talc, glass beads, asbestos, and pulverized mica.

4. The frame of claim 3 wherein the plastic contains from about 5 to about 75 weight percent of the additive.

5. The frame of claim 1 wherein the plastic contains an additive to reduce thermally induced expansion of said plastic member.

6. The frame of claim 1 wherein the insert(s) is a metal selected from the group consisting of aluminum, copper, iron, steel, nickel, titanium, and alloys thereof.

7. The frame of claim 1 wherein the cover is a metal selected from the group consisting of titanium, tantalum, zirconium, tungsten, iron, steel, stainless steel, nickel, lead, molybdenum, cobalt, and alloys thereof.

8. The frame of claim 1 wherein the current collector is selected from the group consisting of wire mesh, mattresses, and perforated plates.

9. The frame of claim 1 wherein the depolarized electrode is a depolarized cathode.

10. The frame of claim 1 including a means to introduce an oxygen-containing gas into the compartment.

11. The frame of claim 1 wherein the depolarized electrode is a depolarized anode.

12. A structural frame adapted for use in an electrochemical cell comprising:

a plastic member with a plurality of horizontally and vertically spaced-apart shoulders protruding outwardly from opposing generally parallel first and second surfaces of said plastic member;

at least one electrically conductive metallic insert extending from an exterior face of a shoulder on an anode surface of the plastic member, through the plastic member, to an exterior face of a shoulder on a cathode surface of the plastic member, wherein each of said shoulders annularly encircles and supports each of said inserts;

an electrically conductive, substantially completely hydraulically impermeable cover resistant to the corrosive effects of an anolyte, welded to at least a portion of the inserts, said cover being adapted to minimize contact between the anolyte and said plastic member;

a silver coated, gas permeable, current collector positioned substantially parallel to a cathode surface of the plastic member and contacting at least a portion of the inserts projecting outwardly from said cathode surface, thereby forming a compartment between the plastic member and the current collector;

a gas inlet passing through at least a portion of the peripheral frame of the plastic member into the compartment between the plastic member and the current collector;

a means to flow an oxygen-containing gas into the compartment between the plastic member and the current collector; and a depolarized cathode positioned substantially parallel to and electrically connected to the current collector.

* * * * *